US006121990A

United States Patent [19]

Fujiwara

[11] Patent Number: 6,121,990

[45] Date of Patent: Sep. 19, 2000

[54] PRINTING APPARATUS AND CARTRIDGE

[75] Inventor: Hitoshi Fujiwara, Nagano, Japan

[73] Assignee: F&F Limited/Seiko Instruments, Nagano, Japan

[21] Appl. No.: 09/165,642

[22] Filed: Oct. 2, 1998

[30] Foreign Application Priority Data

Oct. 3, 1997 [JP] Japan ..... 9-270717

[51] Int. Cl.[7] ..... B41J 2/325

[52] U.S. Cl. ..... 347/222

[58] Field of Search ..... 347/222; 400/691, 400/692, 693, 185

[56] References Cited

U.S. PATENT DOCUMENTS 5,060,076 10/1991 Curley ..... 358/296
5,268,705 12/1993 Dreinhoff et al. ..... 347/218
5,820,275 10/1998 Crawford et al. ..... 400/185

FOREIGN PATENT DOCUMENTS

WO 96/39301 12/1996 WIPO .

*Primary Examiner*—N. Le
*Assistant Examiner*—Shih-Wen Hsieh
*Attorney, Agent, or Firm*—Blank Rome Comisky & McCauley

[57] ABSTRACT

An in-port capable of receiving a cartridge containing a plurality of thermal sheets of standardized size, a platen roller, and a thermal head are generally sequentially aligned in a direction. A thermal sheet picked up from the cartridge is turned at about 180 degrees along the platen roller, and fed out through an out-port arranged in the same side as the in-port. Thus, a very compact, front-in/front-out printer can be realized. Therefore, a card-size printer for the printing sheet of size B7, which can be inserted into a 3.5 inch-file bay, can be provided.

13 Claims, 4 Drawing Sheets

1
1a 5a
7
6
5

11
11a
10
17
5
12

11
17
1a
1
10
12
5
11a

PRINTING APPARATUS AND CARTRIDGE

BACKGROUND OF THE INVENTION

1. Technical Field

The present invention relates to a printing apparatus for printing images such as characters and graphic data on a printing sheet.

2. Description of the Related Art

Recently personal computers have been remarkably improved in aspect of functions year by year. Furthermore the size and cost reduction may allow them to be applied to a variety of fields. A printer, one of the main peripheral devices of the personal computer, has also been improved in aspect of colorization, high resolution, and high operation speed. At present, however, only a large-sized and expensive printer can satisfy the aforementioned high performance. Although a small-sized printer with a simple structure for printing on a sheet of standard size such as size A4 has been available on the market, it fails to satisfy the requirement of high printing speed and high resolution.

Accordingly it has been a trend to use the system in which a printer with a relatively high operation speed and appropriate functions is connected to a plurality of personal computers through network such that a plurality of users share the printer. This system makes it possible to introduce a high-speed, high-resolution color printer at a relatively low cost for various purposes.

However, as a single printer is shared by a plurality of users to receive a plurality of jobs simultaneously, the user cannot obtain the printing result until the preceding job demanded by another user is finished. Therefore, even a small-sized data such as a short electronic mail (e-mail) cannot be printed out until the preceding job is finished. Connecting each printer, instead of the shared printer, to the corresponding personal computer of all users may increase the cost. In particular, the enormous costs will be required if the respective printers are provided for a large number of workers (users) in the office. Even if less expensive printers having relatively lower performance are introduced for saving the cost, each user's desktop space for the printer is required, thus increasing the cost unavoidably. Furthermore, the lower-resolution or lower-speed printer may not satisfy requirements of all the demanded jobs by themselves.

In recent years, portable mobile computers have been widely used, and peripheral devices such as a floppy disk drive have been formed into portable devices. However, a portable printer that can be compact enough to be put into a pocket or a bag has not been available, failing to keep abreast of the "mobile computer age".

It is therefore an object of the present invention to provide a small printing apparatus that can be used by an individual user as a memo pad and occupies only a small space. It is another object of the present invention to provide a printing apparatus which can be connected to an individual personal computer and be used instead of or with the network printer that is high performance but is a large and expensive. It is still another object of the present invention to provide a less expensive printing apparatus that can be used by an individual user to print notes or rough drafts. It is further object of the present invention to provide a printer small enough to be put in a pocket, a bag or the like as a portable printer which can be used with the mobile computer at any time and any place. It is yet another object of the present invention to provide a stile of supplying printing sheets adapted to a small printer.

SUMMARY OF THE INVENTION

Thus, the present invention provides a printing apparatus using thermal sheets and having a front-in/front-out sheet path. Therefore, expendable supplies such as ink and ribbon are not required. As the thermal sheet is thin, the front-in/front-out sheet path can be arranged to be compact. Furthermore, the thermal sheet of standardized size, that is, the paper which has been cut into sheets each having a predetermined size is accommodated in a cartridge, whereby the thermal sheet can be removed from the printer at any time. Therefore, a printing apparatus of the size to be incorporated into a desktop or a notebook personal computer can be designed and produced, thus substantially eliminating the space for the printer. Unlike a large, high-speed printer for color printing with high resolution, a very compact printing apparatus that can be readily used as a memo pad by an individual user can be provided by the present invention.

More specifically, the printing apparatus of the present invention includes an in-port capable of receiving a cartridge containing a plurality of thermal sheets of standardized size, a platen roller having a sheet feeding function, a thermal head. The in-port, platen roller and thermal head are generally sequentially aligned in a direction. The printing apparatus of the present invention further includes a sheet path on which a thermal sheet picked up by a pick-up roller provided at the in-port is guided along a circumference of the platen roller, printed by the thermal head and fed out through an out-port arranged at the side where the in-port is located. Since the in-port, the platen roller and the thermal head are generally aligned in a direction sequentially, the thickness of the printing apparatus can be reduced, resulting in a thin printing apparatus. Moreover, the printing apparatus is provided with a sheet path on which the thermal sheet picked up by the pick-up roller is guided along circumference of the platen roller, printed by the thermal head, and fed out through the out-port. By this sheet path, the thermal sheet can be fed into and fed out of the printer from the same side of the printer, and the length of the printer in a longitudinal sheet feeding direction can be reduced. Furthermore, as the printing apparatus uses thermal sheets, the space for accommodating the expendable supplies can be eliminated. Since the thermal sheet has a small thickness, it can be readily bent. Even when bending the thermal sheet, it cannot be damaged. Therefore, the sheet path can be turned at about 180 degrees along the platen roller having a small diameter. The printing apparatus of the present invention, thus, is of front-in/front-out type and has a small size and thickness.

In the printing apparatus according to the present invention, the thermal head, platen roller, pick-up roller, a motor for driving thereof and a power transmission mechanism are assembled, which can be inserted into a bay for peripheral device formed in a main body of a personal computer. Therefore, a printer which hardly occupies the space can be provided. Moreover, as the in-port and out-port are arranged to be appeared on a surface of the personal computer such as a front surface or a side surface, the printing apparatus becomes completely operable from the personal computer itself. In particular, the printing apparatus of the present invention is very thin, and the printing sheet is fed from the thin cartridge containing thermal sheets of standard size. Therefore, the printing apparatus of the present invention can be down-sized so as to be adapted to a device bay of not only a desktop computer but also a notebook computer.

Moreover, in the printing apparatus of the present invention, as the thermal sheet of standardized size is printed and fed sheet by sheet, which may possibly be slightly displaced in the sheet path due to the tolerance of the sheet path or the like, because such displacement is not accumulated. That allows high-quality printing by a simple sheet feeding mechanism. The aforementioned structure is suitable for constituting the compact printer.

Furthermore, the out-port is arranged above the in-port such that the printed sheet is fed out through the out-port to be placed on the cartridge that has been inserted into the in-port. Thus, the cartridge can be used as a sheet tray where printed sheets are placed. Since the thermal sheets are set in the cartridge with the printing surface directed downward, the thermal sheet can be fed out through the out-port onto the cartridge with its printed surface directed upward. This may allow the user to view the printing result immediately.

The printing apparatus of the present invention makes it possible to accommodate a driving motor within the platen roller. With such an arrangement, the printing apparatus can be further down-sized. Moreover, the sheet feeding speed can be selected from the rapid feeding speed and the printing speed by changing the rotating direction of the motor. By changing the rotating direction of the motor, the position of the thermal head can also be switched between a position in which the thermal head is apart from the platen roller and a position in which the thermal head is in contact with the platen roller. Since the printer can be entirely controlled by a single motor, a control mechanism is significantly simplified and the number of motors is reduced. Therefore, the space for the control mechanism and the motor can be reduced and resulting in further compact printer.

Since the printing apparatus of the present invention can be substantially down-sized, it becomes not only an incorporate type into a main body of the personal computer but also a type suitable for portable use. Furthermore, as the main body of the printing apparatus and the cartridge can be carried separately, a practical portable printer which can be carried anywhere in a pocket, a bag or the like can be realized. Moreover, even when the printer has been inserted into a device bay of a notebook personal computer, the cartridge can be removed from the printer, and the cartridge and the printer can be separately carried. Therefore, the cartridge does not protrude from the notebook personal computer. Thus,the printer can be carried together with a portable notebook personal computer without deteriorating portability of the portable notebook personal computer.

DESCRIPTION OF THE PREFERRED EMBODIMENT

Figure 1:
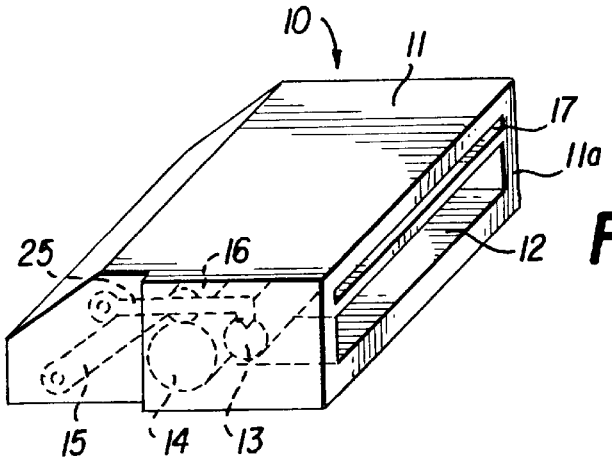
FIG. 1 is a perspective view schematically showing a printer according to an embodiment of the present invention.
Figure 2A:
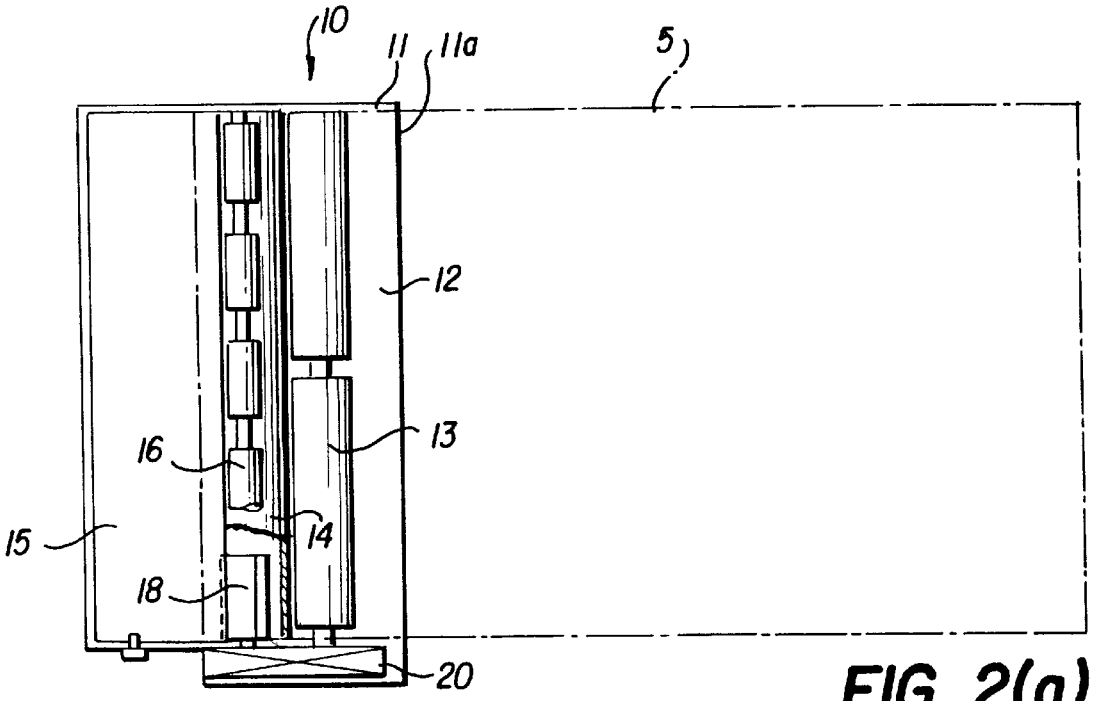
FIG. 2 is a plan view schematically showing a planar structure of the printer of FIG. 1 (FIG. 2(*a*)) and a side view schematically showing a side section of the printer of FIG. 1 (FIG. 2(*b*))
Figure 2B:
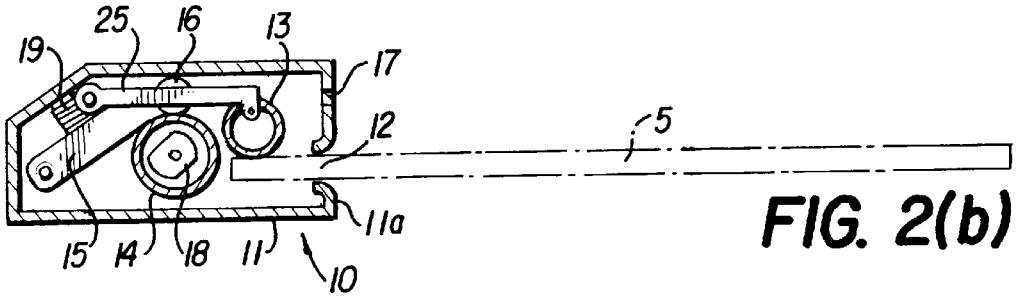

Referring to the drawings, embodiments of the present invention will be described hereinafter. FIG. 1 shows an outer appearance of a printer 10 according to an embodiment of the present invention. FIG. 2 is a cross sectional view schematically showing a planar structure of the printer 10 of the present embodiment (FIG. 2(*a*)), and a side cross sectional view schematically showing the structure of the printer 10 (FIG. 2(*b*)). The printer 10 of the present embodiment includes a thin rectangular housing 11 having a width (in the vertical direction of FIG. 2(*a*)) of about 100 mm, a length (in the horizontal direction of FIG. 2(*a*)) of about 50 mm and a thickness of about 25 mm. Assuming that the side where an in-port 12 for inserting a cartridge is formed is specified as the front 11*a* of the housing 11, the in-port 12, a pick-up roller 13 provided thereabove, a platen roller 14 having a sheet feeding function, and a thermal head 15 for printing on a thermal sheet are generally sequentially aligned in this order from the front 11*a* in the horizontal direction. Moreover, an auxiliary roller 16 for feeding out the thermal sheet is provided above the platen roller 14, and an out-port 17 is provided above the in-port 12 of the cartridge. Thus, the thermal printing sheet is picked up from the cartridge 5 by the pick-up roller 13, fed by the platen roller 14, and printed by the thermal head 15 while the thermal sheet being supported by the platen roller 14. Thereafter, the printed thermal sheet is fed out through the out-port 17 onto the cartridge 5.

In the printer 10 of this embodiment, a motor 18 as a power source is accommodated in the platen roller 14 such that power of the motor 18 is transmitted to the platen roller 14 and the pick-up roller 13 through a gear string 20. Moreover, an arm 25 for controlling the position of the thermal head 15 extends from one end of the thermal head 15 to a driving wheel 13*a* of the pick-up roller 13. Therefore, the position of the thermal head 15 can be controlled according to the rotating direction of the pick-up roller 13.

Figures 3A, 3B, 3C, 3D:
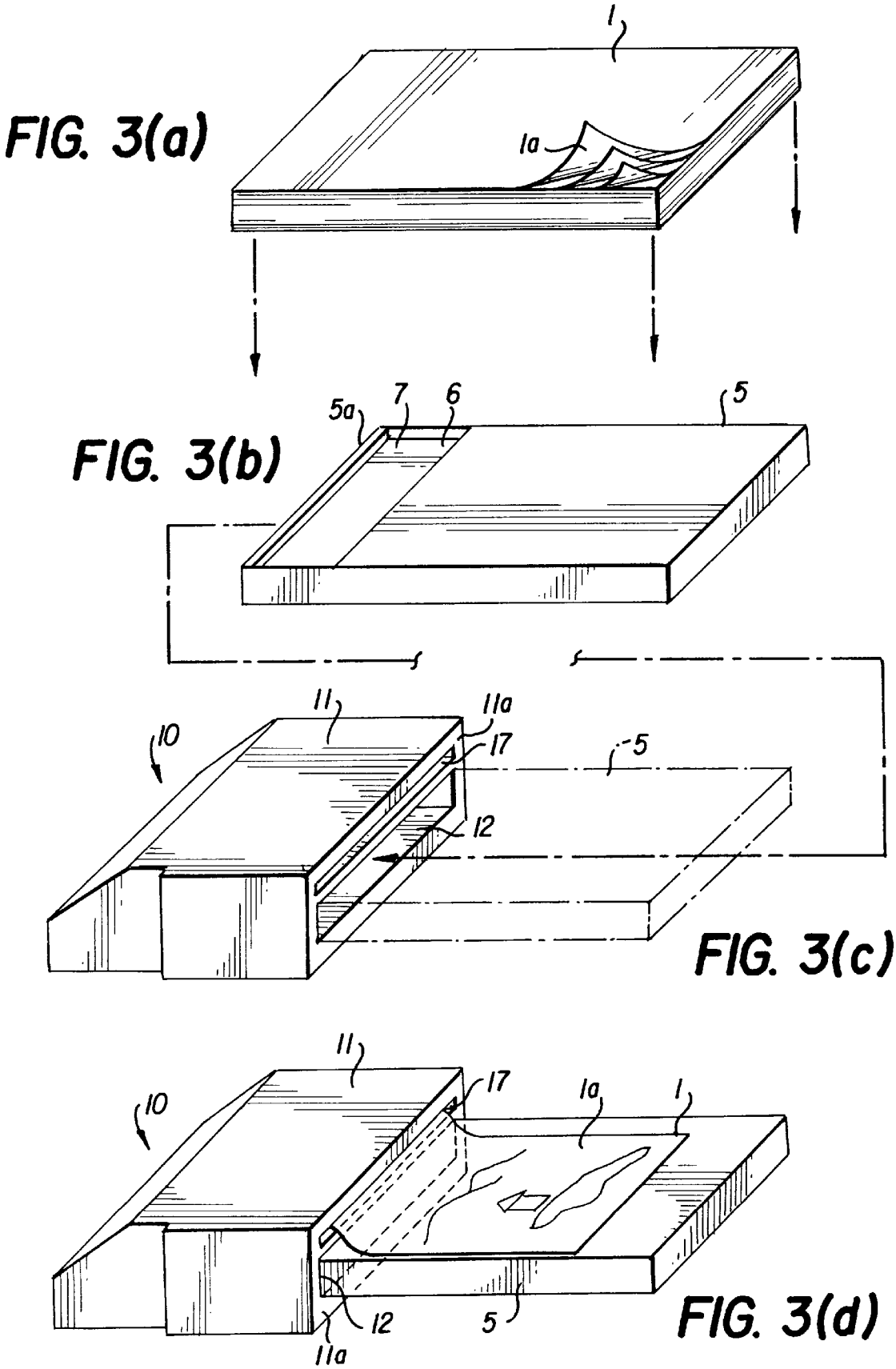
FIG. 3 is a series of diagrams illustrating the steps of attaching a cartridge, according to the present invention, containing thermal sheets to the printer of FIG. 1 for printing.

FIG. 3 illustrates a series of procedures from setting the printing sheet into the printer 10 of the present embodiment to printing on the printing sheet. In the printer 10 of the present embodiment, the cartridge (sheet cassette) 5 accommodating a plurality of printing sheet (thermal sheet) 1 is inserted into the in-port 12 for printing. The printer 10 includes the thermal head 15 as a printing head, whereby the thermal sheet 1 can be printed without using ink, ribbon, toner or the like. Moreover, the printer 10 of the present embodiment can conduct printing on a standardized size sheet cut out of size B7 (width: about 91 mm; length: about 128 mm) having a width slightly smaller than the width of the housing 11. The user places a plurality of standardized size thermal sheet 1 shown in FIG. 3(*a*) in the cartridge 5 with light-shielding capability shown in FIG. 3(*b*). Alternatively, the user may purchase a commercially available cartridge 5 accommodating a plurality of thermal sheet of standardized size. Then as shown in FIG. 3(*c*), the thus prepared cartridge 5 is inserted into the opening 12 for printing. If the thermal sheet 1 is exposed to, for example, the sunlight for a long time, the sensitivity thereof may be degraded due to increase in its surface temperature. Therefore, the thermal sheet 1 is desirably accommodated in a light-shielding cartridge made of paper, plastic or the like. Moreover, since the thermal sheets 1 are accommodated in the cartridge 5, they can be removed from the printer 10 by merely removing the cartridge 5 from the printer 10. Since the thermal sheet 1 has a small size, the cartridge 5 containing the thermal sheets 1 can be readily stored or carried with the user. Moreover, the printing sheets can be kept from being folded and wrinkled, thus preventing troubles of the printer such as paper jam.

A shutter 6, which opens and closes in the direction parallel to the sheet feeding direction, is provided at one end (at sheet feeding side or sheet insertion side) 5*a* of the cartridge 5. Therefore, upon insertion of the cartridge 5 into the in-port 12 of the printer 10 from the sheet feeding side 5*a* as shown in a dashed line of FIG. 3, the shutter 6 engages with the pick-up roller 13 or other appropriate member of the printer to open a sheet feeding port 7.

Furthermore, the printer 10 of the present embodiment is provided with an out-slit 17 located above the in-opening 12. As shown in FIG. 3(*a*), the thermal sheets 1 are set in the cartridge 5 each having the printing surface la of the thermal sheet 1 directed opposite to the sheet feeding port 7. In other words, the thermal sheet 1 is placed in the cartridge 5 with the printing surface 1*a* directed downward. Accordingly, as shown in FIG. 3(*d*), the thermal sheet 1 is printed through a sheet path which will be described below, and fed out through the out-port 17 onto the cartridge 5 with its printing surface 1*a* directed upward. Thus, the printing result can be viewed immediately after printing. At this time, the cartridge 5 is used as an output sheet tray.

Figure 4:
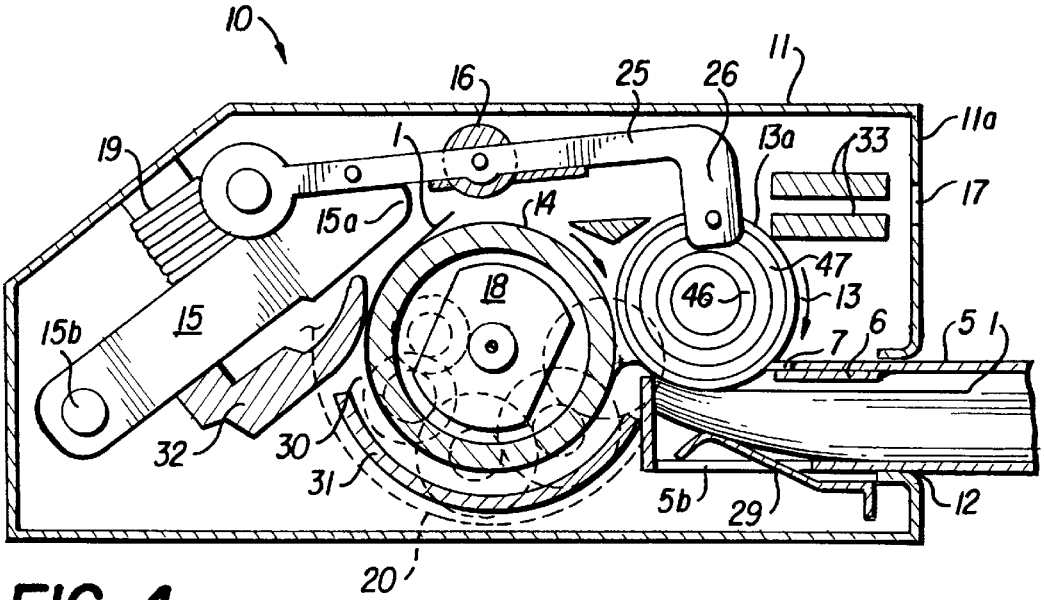
FIG. 4 is a cross sectional view of the printer shown in FIG. 1 illustrating a state where the thermal sheet is setting.

FIG. 4 is an enlarged view showing how the thermal sheet 1 is fed from the cartridge 5 into the printer 10. In the printer 10 of this embodiment, when the motor 18 provided inside of the platen roller 14 is rotated clockwise, the platen roller 14 and the pick-up roller 13 rapidly rotate clockwise (in the sheet feeding direction) through the gear string (wheel string) 20 as shown by the dashed lines in FIG. 4. The shutter 6 of the cartridge 5 set into the in-port 12 is opened in abutment with the pick-up roller 13. As a result, the sheet feeding port 7 is opened to bring the pick-up roller 13 in contact with the thermal sheet. Moreover, a bottom plate 29 provided at the in-port 12 enters the cartridge 5 through an opening 5*b* provided in the bottom of the cartridge 5. The bottom plate 29 presses the thermal sheet 1 upward against the pick-up roller 13, thereby facilitating the sheet feeding operation. The bottom plate (sheet pressing plate) 29 shown in this embodiment directly presses the thermal sheet 1. However, a plate covers the opening 5*b* of the cartridge 5 may be provided in the cartridge 5. The plate capable of moving in the vertical direction such that the bottom plate 29 can press the thermal sheet 1 against the pick-up roller 13 through the plate, resulting in excellent light-shielding capability.

The thermal sheet 1 is fed from the cartridge 5 to the inside of the printer 10 by the pick-up roller 13 and guided downward in abutment with the platen roller 14. It further passes through the sheet path 30 between the platen roller 14 and the sheet guide 31 to be turned at approximately 180 degrees along the circumference of the platen roller 14 to the thermal head side. The thermal head 15 of the present embodiment is designed such that its printing portion 15*a* facing the platen roller 14 can pivotally rotate about a portion 15*b* located opposite to the printing portion 15*a*. Hence, by the movement of a lever-like arm 25 attached to one end of the thermal head 15, the position of the thermal head 15 can be switched between a sheet setting position and a printing position. At the sheet setting position, the printing portion 15*a* of the thermal head 15 is apart from the platen roller 14. In the printing position, the printing portion 15*a* of the thermal head 15 is in contact with the platen roller 14, by which the printing sheet is interposed therebetween.

Moreover, the printer 10 of the present embodiment uses the thermal sheet of standardized size, instead of roll paper, accommodated within the cartridge 5. Therefore the printing sheet 1 is fed sheet by sheet for printing. Even if the printing sheet 1 is slightly displaced with respect to the sheet path owing to the tolerance thereof, the displacement will not be accumulated and hardly affect the next printing job. As a result, accuracy of the element such as a pick-up roller and a platen roller does not have to be improved to the greatest degree. The resultant printer may provide high-quality printing yet producible at low costs.

Figure 6:
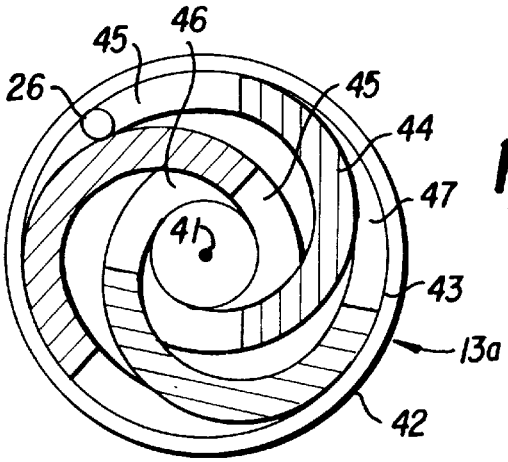
FIG. 6 is a view illustrating an exemplary cam lead used in the printer shown in FIG. 1.

As shown in FIG. 6, the printer 10 of the present embodiment is provided with the driving wheel 13*a* which rotates together with the pick-up roller 13. A plurality of cam leads 43 helically extending counterclockwise from the center 41 to the outer periphery 42 are provided in the driving wheel 13*a*. In each of the cam lead 43, a lead portion 45 at the center has an upper or upward bottom, a lead portion 44 between the center and the outer periphery has a lower or downward bottom, and the lead portion 45 at the outer periphery has an upper or upward bottom. Moreover, an outer lead 47 circularly moving along the outer periphery 42 and an inner lead 46 circularly moving at the central portion 41 are formed.

A cam follower 26 is provided at the end of the arm 25 for controlling the position of the thermal head 15, which is set in the cam lead 43 of the driving wheel 13*a*. When the driving wheel 13*a* rotates clockwise (in the sheet feeding direction), the cam follower 26 moves along the outer lead 47. Accordingly, as shown in FIG. 4, the arm 25 is lifted up such that the thermal head 15 moves away from the platen roller 14 into the sheet feeding position. Meanwhile the pick-up roller 13 is strongly pressed against the thermal sheet 1 within the cartridge 5 due to the counteraction resulting from lifting up the arm 25. Accordingly, the thermal sheet 1 can be easily picked up.

Figure 5:
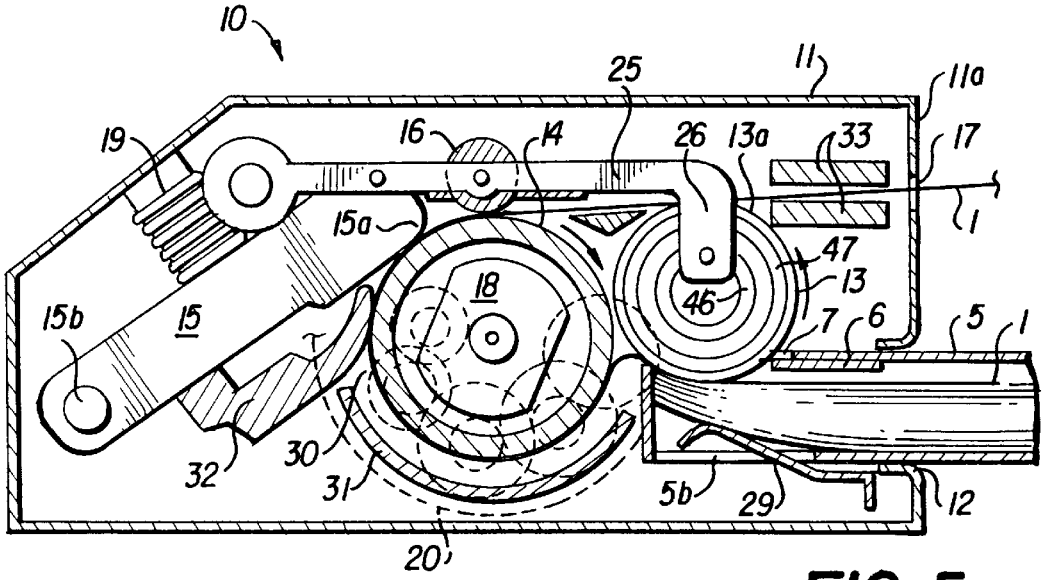
FIG. 5 is a cross sectional view of the printer shown in FIG. 1 illustrating a printing state for printing.

When the leading edge of the thermal sheet 1 guided along the sheet path 30 passes through the sheet guide 32 moving along the thermal head 15 to reach a predetermined position past the thermal head 15, the motor 18 is switched to rotate counterclockwise. Therefore, the driving wheel 13*a* is also rotated counterclockwise to guide the cam follower 26 from the portion 45 with an upper bottom to the portion 44 with a lower bottom of the cam lead so as to move from the outer lead 47 to the inner lead 46. As shown in FIG. 5, the arm 25 moves down. As the thermal head 15 is pressed against the platen roller 14 by a spring 19 attached to the inside of the housing 11, when the arm 25 moves down, the thermal head 15 pivots around its one end 15*b* such that the other end of the thermal head 15, i.e., the printing portion 15*a* is brought into contact with the platen roller 14 interposing the thermal sheet 1 therebetween. The thermal head 15, then, becomes ready to print.

According to the printer 10 of the present embodiment, using the rotating direction of the pick-up roller 13 that is switched by changing the rotating direction of the motor 18, the arm 25 is moved in the above-described manner so as to control the position of the thermal head 15. At the pick-up roller 13, the pressure against the thermal sheet 1 in the cartridge becomes weak by counteraction of lifting down the arm 25 resulting from movement of the cam follower 26 to the inner lead 46. In addition, the pick-up roller 13 rotates in the direction opposite to the sheet feeding direction. The thermal sheet 1 guided to the sheet path 30 is fed in the sheet feeding direction by the platen roller 14 as described below. Therefore, the sheet feeding is not disturbed even if the pick-up roller 13 rotates in the opposite direction under the reduced pressure. Such rotation of the pick-up roller 13 functions to prevent dragging of the subsequent thermal sheet 1 from the cartridge 5 together with the preceding sheet. Therefore, by the interlocking operation between the thermal head 15 and pick-up roller 13 using the arm 25, the thermal sheet 1 within the cartridge 5 is reliably fed sheet by sheet. As a result, the printer 10 capable of reliably printing on the printing sheet can be realized.

As shown in FIG. 5, when the motor 18 is switched to rotate counterclockwise, the gear string 20 for transmitting the power of the motor 18 to the platen roller 14 is also switched to rotate the platen roller 14 clockwise (in the sheet feeding direction) at a low speed suitable for printing. Several mechanisms using a plurality of gears and a one-way clutch or a planetary gear may be used as the mechanism for switching the gear string 20 which changes the rotating speed of the platen roller, 14 according to the rotating direction of the motor 18.

It should be noted that, in the present embodiment, a cam lead is shown to be used as a mechanism for vertically moving the arm for controlling the position of the thermal head. However, the present invention is not limited to this, and a substantially equivalent control mechanism can be realized by using other mechanisms such as a mechanism using a ratchet. Moreover, as the rotating direction of the motor 18 changes depending on the structure of the gear string 20 or the like, control similar to that described herein can also be achieved even when setting the rotating direction of the motor 18 opposite to the direction described in this embodiment.

In the printer 10 of the present embodiment, when the motor 18 rotates counterclockwise, the thermal head 15 becomes ready to print, and the platen roller 14 is rotated clockwise (in the sheet feeding direction) at a printing speed. Accordingly, the printed thermal sheet 1 is guided clockwise along the platen roller 14, and turned at about 180 degrees into the front 11*a* of the housing 11. An auxiliary roller 16 provided in the center of the arm 25 is in contact with the upper portion of the platen roller 14. The printed thermal sheet 1 is guided between the auxiliary roller 16 and the platen roller 14, and further fed into the out-port 17. The auxiliary roller 16 moves in vertical direction together with the arm 25. Therefore, as shown in FIG. 4, the auxiliary roller 16 is apart from the platen roller 14 when setting the thermal sheet, thus preventing interference such as paper jam at thermal sheet setting.

The printed thermal sheet 1 fed by the auxiliary roller 16 is guided through a plurality of sheet guides 33 into the out-port 17. Then, as shown in FIG. 3(*d*), the printed thermal sheet 1 is fed out through the out-port 17 onto the cartridge 5 fitted with the in-port 12. The printer 10 of the present embodiment is a front-in/front-out printer in which the printing sheet is set and fed out from the front 11*a* of the printer 10. Moreover, the cartridge 5 is used as a sheet tray for receiving the printed thermal sheet 1.

When the printer 10 completes the printing and receives subsequent printing data, the motor 18 again rotates clockwise, by which the next thermal sheet 1 is picked up from the cartridge 5 and fed into the printer 10. When the sheet feeding operation is completed, the motor 18 rotates counterclockwise for printing. Thus, in the printer 10 of the present embodiment, the sheet feeding operation and the printing operation can be switched by merely changing the rotating direction of the motor 18. The position of the thermal head 15 is also changed in conjunction with the rotating direction of the motor 18, thus realizing smooth feeding operation and reliable printing operation. Accordingly, the control mechanism such as the platen roller can be significantly simplified, reducing the number of components of the printer 10. As a result, the gear string 20 serving as a power transmission mechanism can be disposed in a substantially restricted space as shown in FIG. 2. Moreover, the arm 25 serving as a mechanism for controlling the position of the thermal head 15 can be accommodated in the space for the gear string 20. Therefore, the entire mechanism of the printer can be accommodated within the housing 11 slightly wider than the cartridge 5.

Furthermore, the in-port 12, the platen roller 14 and the thermal head 15 are generally sequentially aligned in the horizontal direction, thus realizing a very thin printer 10. Moreover, since the printer 10 includes the thermal head 15 and uses the thermal sheet for printing, expendable supplies such as ink, toner or ribbon can be eliminated. That is, no space for such expendable (consumable) supplies is required. As the thermal sheet is thin, the radius of curvature of the sheet path 30 arranged within the printer 10 can be reduced, by which the diameter of the platen roller 14 can also be reduced. As a result, the front-in/front-out sheet path 30 can be incorporated into the thin and compact housing 11.

Figure 7:
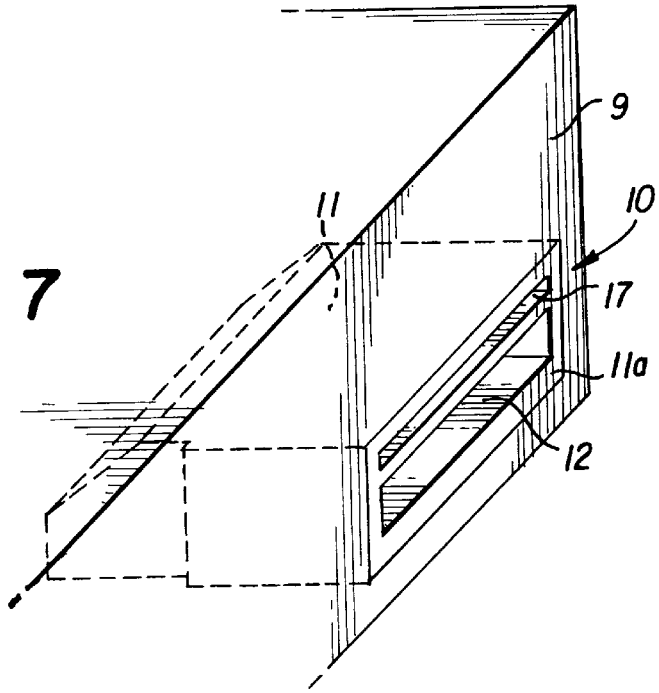
FIG. 7 is a diagram illustrating that the printer of FIG. 1 has been set into a personal computer.

Thus, being thin and compact, the printer 10 can be sufficiently inserted into, for example, a 3.5 inch-file bay (device bay) provided in a personal computer for a peripheral device such as a floppy disk or CD-ROM. Moreover, as the aforementioned printer 10 is of front-in/front-out type, it can be accommodated in a housing 9 of a personal computer as shown in FIG. 7. Accordingly, the printer 10 can be incorporated into a desktop personal computer, which occupies no desktop space. In addition when the computer is notebook type, the printer 10 can be carried together with the notebook personal computer. In the case where the printer 10 is sized to be inserted into, for example, a 3.5 inch-file bay, printing on the printing sheet of size B7, as maximum size for such a small printer, can be achieved. The resolution of the resultant printing is lower than that of the large printers using the printing sheet of size A4. The aforementioned compact printer, however, functions sufficiently to print e-mail messages, a small amount of document or image like a memo pad. Thus, the printer 10 of the present embodiment can be used for purposes different from those of a network computer or the like, and is used preferably by individual users for their own purposes. Moreover, since the printer 10 of the present embodiment employs a small and simple mechanism, the production cost can be reduced. This makes it possible to provide the printer at a reasonable price to the user. From this point as well, the printer 10 of the present embodiment is suitable for personal use. Since the printer 10 of the present embodiment uses the small printing sheet of standardized size such as B7, the driving mechanism is simplified. Therefore, the load exerted to the motor is small, by which the entire printer can be controlled by a single motor. Accordingly, power consumption can be reduced, and the printer 10 together with a personal computer and the like can be driven sufficiently by a battery.

Figure 8:
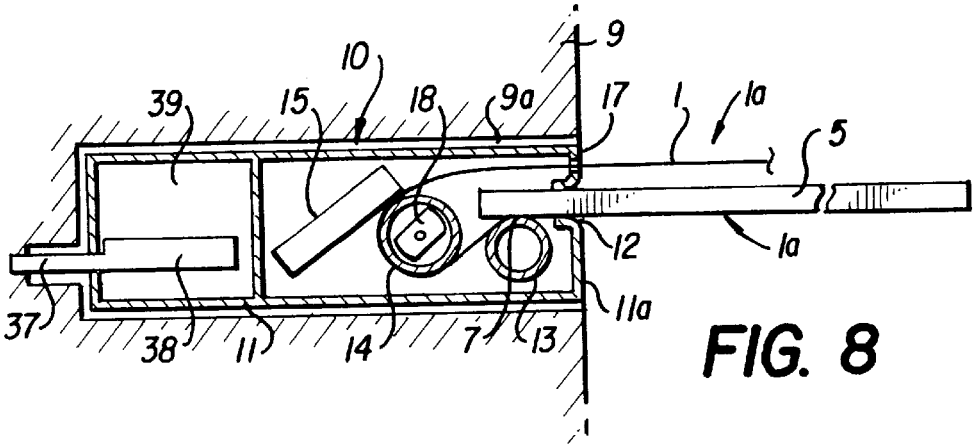
FIG. 8 is a schematic diagram of a printer of another embodiment which can be set into a personal computer according to the present invention.

FIG. 8 schematically shows a structure of a printer 10 of different type according to another embodiment. The printer 10 can be accommodated in the housing (main body) 9 of the personal computer. In the printer 10 of the present embodiment, an in-port 12 for a cartridge 5, a platen roller 14 having a sheet-feeding function, and a thermal head 15 are sequentially aligned within a thin housing 11 of the printer 10 from the front 11*a* of the printer 10 in a direction like the printer 10 of the former embodiment. However, in the printer 10 of the present embodiment, a pickup roller 13 is provided at the lower side of the in-port 12. Therefore, when the cartridge 5 is inserted into the in-port 12, the thermal sheet 1 can be picked up from the lower side of the cartridge 5. Accordingly, unlike the printer 10 of the former embodiment, the thermal sheet 1 is set in the cartridge 5 with its printing surface 1*a* directed toward a sheet feeding port 7 of the cartridge 5, and the cartridge 5 is inserted into the printer 10 with the sheet feeding port 7 directed downward such that the thermal sheet 1 is set in the printer 10 with its printing surface 1*a* directed downward. The thermal sheet is guided from the sheet feeding port 7 of the cartridge 5 to the platen roller 14 and fed clockwise along the platen roller 14, as in the case of the printer of the former embodiment. Then, printing is conducted on the thermal sheet 1 by bringing its printing surface 1*a* into contact with the thermal head 15, and the printed thermal sheet 1 is fed out from the out-port 17 onto the cartridge 5 with the printing surface 1*a* directed upward.

As in the case of the printer 10 of the former embodiment, the printer 10 of the present embodiment is also thin. Moreover, the length of the printer 10 of the present embodiment is reduced in the longitudinal sheet feeding direction enough to be accommodated in the main body 9 of the personal computer. In the printer 10 of the present embodiment, a space 39 for accommodating a circuit board 38 having a function for controlling the printer is provided adjacent to the printing mechanism. The housing 11 is adapted for insertion into a bay 9*a* for a peripheral device, and a connector connected to the circuit board 38 is provided at one end of the housing 11. The connector may be in accordance with some general-purpose standards such as USB standard. Accordingly, the printer 10 can be connected to the personal computer by merely inserting the housing 11 into the bay 9*a* provided in the main body 9. Thus, the printer 10 of the present embodiment is adapted for insertion into the main body 9 of the personal computer, by which printing can be conducted without occupying the extra space for the printer.

It should be understood that the printer 10 of the present invention itself can be used as an independent peripheral device. The present invention makes it possible to provide the printer that can be put into a pocket. Moreover, the printer 10 uses the cartridge 5 adapted for insertion therein. The printer 10 as a separate device or as being accommodated in the notebook personal computer allows the cartridge 5 to be removed therefrom for carrying and storing separately. When the cartridge 5 is removed from the printer 10, the printer 10 itself has a card size of about 10 cm×5 cm, and therefore, can be carried in a pocket, bag or the like. Accordingly, the printer 10 can be used as a practical portable information apparatus together with a compact mobile computer or the like, allowing the user to use the printer any time and any place.

It should be noted that although the printer that can be accommodated in the 3.5 inch-file bay has been described in the foregoing embodiment, the present invention is not limited to this size. A printer having a size suitable for the thermal sheet of the size A7 or larger, or A8 or smaller, can be provided. A card-size portable printer can be realized by this invention, moreover a further smaller printer using the card-size printing sheet can also be provided.

As has been described above, the printer of the present invention can be constructed as a compact thermal printer that is small enough to be accommodated into a bay for a peripheral device provided in the main body of the personal computer, and/or is a card-size printer. Therefore, the space for the printer is eliminated, and the printer can be accommodated in the main body of the personal computer. Unlike a high-performance network printer, a printer that can be used as a memo pad by the user or as a printer that can be carried with the user any time and any place together with a compact mobile computer can be provided according to the present invention.

What is claimed is:

1. A printing apparatus comprising:

an in-port capable of receiving a removable cartridge containing a plurality of thermal sheets;

a platen roller having a sheet feeding function;

a direct thermal head;

said in-port, platen roller and thermal head are generally sequentially aligned; and a sheet path on which a thermal sheet picked up by a pick-up roller provided at said in-port is guided along said platen roller, printed by said thermal head and fed out through an out-port arranged at the side where said in-port is located;

a motor and a power transmission mechanism capable of driving said platen roller and said pick-up roller, said power transmission mechanism rotates said pick-up roller and platen roller at a high speed in a sheet feeding direction when said motor rotates in a first direction, and rotates said platen roller at a printing speed when said motor rotates inversely; and a position control mechanism for bringing said thermal head to a position away from said platen roller when said motor rotates in said first direction, and bringing said thermal head in contact with said platen roller when said motor rotates inversely.

2. A printing apparatus according to claim 1, wherein said thermal head, platen roller, pick-up roller, motor, position control mechanism, and power transmission mechanism are assembled that can be inserted into a bay for peripheral device formed in a main body of a computer, and said in-port and out-port are arrange to be appeared on a surface of said personal computer.

3. A cartridge having a size that can be inserted into said in-port of the printer described in claim 2 comprises a sheet feeding port at one end thereof.

4. A cartridge according to claim 3 further comprising a shutter capable of opening and closing said sheet feeding port.

5. A printing apparatus according to claim 1, wherein said out-port is arranged above said in-port.

6. A printing apparatus according to claim 1, wherein a plurality of thermal sheets are set at said in-port with each printing surface directed downward such that a thermal sheet that has been printed is fed out through said out-port with its printed surface directed upward.

7. A printer apparatus according to claim 1, wherein said thermal head, platen roller, pick-up roller, motor, position control mechanism and power transmission mechanism are essentially assembled in a flat orientation along the direction of cartridge reception, said in-port and said out-port being arranged on the same surface.

8. A cartridge having a size that can be inserted into said in-port of the printer of claim 7 comprises a sheet feeding port at one end thereof.

9. A cartridge according to claim 8 further comprising a shutter capable of opening and closing said sheet feeding port.

10. A printer apparatus according to claim 7, wherein the size of the printer apparatus is adapted to be inserted into a bay for a peripheral device formed in a main body of a personal computer and wherein said in-port and said out-port are arranged to appear on a surface of said personal computer.

11. A cartridge having a size that can be inserted into said in-port of the printer of claim 10 comprises a sheet feeding port at one end thereof.

12. A cartridge according to claim 11 further comprising a shutter capable of opening and closing said sheet feeding port.

13. A printing apparatus comprising:

an in-port capable of receiving a removable cartridge containing a plurality of thermal sheets;

a platen roller having a sheet feeding function;

a direct thermal head, said in-port, platen roller and thermal head are generally sequentially aligned; and a sheet path on which a thermal sheet picked up by a pick-up roller provided at said in-port is guided along said platen roller, printed by said thermal head and fed out through an out-port arranged at the side where said in-port is located, wherein said motor is capable of driving said platen roller and said pick-up roller is accommodated with said platen roller.

* * * * *